US007649350B2

(12) United States Patent
Heyden et al.

(10) Patent No.: US 7,649,350 B2
(45) Date of Patent: Jan. 19, 2010

(54) RAILCAR PRESENCE DETECTOR

(75) Inventors: Thomas J. Heyden, Arlington Heights, IL (US); Lowell Ziese, Pewaukee, WI (US)

(73) Assignee: AAA Sales & Engineering, Inc., Oak Creek, WI (US)

( * ) Notice: Subject to any disclaimer, the term of this patent is extended or adjusted under 35 U.S.C. 154(b) by 385 days.

(21) Appl. No.: 11/758,044

(22) Filed: Jun. 5, 2007

(65) Prior Publication Data

US 2008/0303518 A1 Dec. 11, 2008

(51) Int. Cl.
*G01B 7/14* (2006.01)
*B61L 11/00* (2006.01)

(52) U.S. Cl. ..... 324/207.26; 324/260; 324/225; 324/228; 246/249; 246/202; 246/247

(58) Field of Classification Search ..... 324/207.26, 324/260, 225, 228; 246/249, 202, 247
See application file for complete search history.

(56) References Cited

U.S. PATENT DOCUMENTS 3,951,364 A 4/1976 Sibley
4,034,677 A 7/1977 Frank
4,059,054 A 11/1977 Alimanestianu et al.
4,179,744 A * 12/1979 Lowe ..... 701/35
5,395,078 A 3/1995 Gellender
5,417,388 A * 5/1995 Stillwell ..... 246/122 R
5,471,139 A 11/1995 Zadoff
5,491,475 A 2/1996 Rouse et al.
5,628,479 A 5/1997 Balliner
5,868,360 A 2/1999 Bader et al.
6,064,315 A 5/2000 Orlassino et al.
6,292,112 B1 9/2001 Bader et al.
6,371,417 B1 4/2002 Southon
6,663,053 B1 12/2003 Shams

OTHER PUBLICATIONS

"2-Axis Magnetic Sensor HMC1042L", Honeywell, pp. 1-6, 900340, Nov. 2006.
"Handling Sensor Bridge Offset", Honeywell, AN212, pp. 1-6, 900297 05-02 Rev.
"Set/Reset Function For Magnetic Sensors", Honeywell, AN213, pp. 1-8, 900298 08-02 Rev.
HE-XE102 Specification, Horner, pp. 1-2, MAN0808-03, Jul. 15, 2006.
"1- and 2-Axis Magnetic Sensors" Honeywell, pp. 1-15, 900248 Rev. B, Apr. 2000.

* cited by examiner

*Primary Examiner*—Reena Aurora
(74) *Attorney, Agent, or Firm*—Andrus, Sceales, Starke & Sawall, LLP

(57) ABSTRACT

A railcar presence detector including magnetic field sensors spaced along the length of a rail track for detecting magnetic field disturbances caused by ferromagnetic objects, such as railcars, passing along the rail track. Each of the magnetic field sensors generates an output signal that is received by a control unit. The control unit compares the output signal from each of the magnetic field sensors to a detection threshold and controls the position of a contact member dependent upon the comparison between the output signal and the detection threshold. Each of the magnetic field sensors includes a test device that is selectively operable to modify the magnetic field near the magnetic field sensor to test the operation of the magnetic field sensor. During operation of the system including the magnetic field sensor, the control unit can automatically activate the test device to assure that each of the magnetic field sensors are operating properly.

22 Claims, 7 Drawing Sheets

RAILCAR PRESENCE DETECTOR

BACKGROUND OF THE INVENTION

The present invention generally relates to a control system for detecting the presence of a railcar along a length of track. More specifically, the present invention relates to a presence detector that includes a plurality of magnetic field sensors that each detect the presence of a railcar on a length of track and includes components for calibrating the output signal from each of the magnetic field sensors to adjust for the earth's magnetic fields in the location near the magnetic field sensor.

Since the inception of railroads, the control of trains along tracks, and specifically along the multiple parallel, closely spaced tracks typically included in rail yards, has been a priority and concern to prevent injury and damage. Part of the process of controlling the movement of trains through a rail yard requires the need for the automatic detection of railcars along each two-rail track included in the rail yard. Since many switching and arresting devices are automatically controlled in a rail yard, identifying the presence of railcars along the individual tracks is imperative to prevent collision and derailment.

Early detection devices oftentimes utilized pressure switches that operated upon movement of a track section due to the train weight and/or electrical contact switches that are operated through conduction of the train wheels. Although these prior systems provided some type of indication of a railcar presence, the systems included numerous drawbacks, which are primarily focused upon the operation of the pressure or conductive switches utilized along the length of the rail.

Another type of detector that has also been used to detect railcars within a rail yard utilizes photoelectric detectors to detect the presence of a railcar along a length of track. Although photoelectric detectors operate well in perfect conditions, the detectors oftentimes need to be calibrated or cleaned to remove dirt or snow that can block the photo detectors.

A presently available and commonly utilized railcar detector utilizes a continuous inductive coil buried beneath the rail track that includes multiple windings of an electrically conductive material. As the railcar passes over the coil of wire, the changing magnetic field created by the ferromagnetic material from the railcar changes the electrical current generated within the inductive coil. Thus, a change in the voltage from the inductive coil resulted in a train presence signal. Although this type of train detector system works fairly well, damage to any portion of the inductive coil results in failure of the entire detection system. Following such damage, repair personnel must initially identify the damage to the coil and subsequently replace the damaged area. The identification and repair of the damaged section of the sensing coil required both highly trained personnel and a significant amount of down time within the rail yard.

Therefore, a need exists for a railcar presence detector that is both robust and easily repairable to detect the presence of railcars along rail tracks within a rail yard. A need exists for such a system that can both accurately detect the railcar and provide a failsafe mode of operation to prevent damage and/or derailment of railcars within the rail yard.

SUMMARY OF THE INVENTION

The present invention relates to a system and method for detecting the presence of a railcar along a rail track. The detection system detects the presence of the railcar and operates a contact member based upon the detected presence of the railcar.

The railcar detection system includes at least a pair of sensor units that are positioned along the length of a two rail track. Preferably, each of the sensor units are positioned between the two rails and are spaced from each other along the length of the track by a desired distance. Each of the sensor units preferably includes a single plane magnetic field sensor that senses the presence of ferromagnetic material, such as railcars, at a location near the magnetic field sensor. When a ferromagnetic mass approaches or moves away from the magnetic field sensor, the output voltage from the magnetic field sensor changes. The output voltage generated by the magnetic field sensor is directly dependent upon the magnetic field near the magnetic field sensor. Thus, as a ferromagnetic object moves toward the magnetic field sensor, the output signal generated by the sensor unit changes. Likewise, when the ferromagnetic mass moves away from the magnetic field sensor, the magnetic field near the magnetic field sensor is different than the steady state, causing the output signal from the sensor unit to vary.

In a preferred embodiment of the invention, the magnetic field sensor of each sensor unit is contained within a protective housing and can be quickly mounted/removed from between the rails. In this manner, the entire sensor unit can be removed and replaced should the sensor unit become damaged or otherwise rendered non-functional.

Preferably, each of the magnetic field sensor units includes both a test device and an offset device contained within the enclosed housing. Since each of the magnetic field sensors generates an output signal dependent upon the magnetic field near the magnetic field sensor, the offset device allows a user to adjust the value of the output signal during ambient conditions when no railcar is present. Preferably, the offset device is utilized to center the output signal within the maximum and minimum range of operation for the magnetic field sensor. The use of the offset device allows the magnetic field sensor to be calibrated to compensate for the magnetic field present at the location where the magnetic field sensor unit is installed.

The railcar presence detection system includes a display associated with the control unit that includes a visual representation of the output signal from each of the magnetic field sensor units. During initial calibration, the offset device of the sensor unit is utilized to calibrate the magnetic field sensors. During initial calibration, a visual representation of the output signal from the sensor unit is shown on the display device. During normal operations, the value of the output signal from each of the sensor units is also shown on the display device connected to the control unit such that the output signal from each of the plurality of magnetic field sensors can be visually monitored.

In addition to the offset device, each sensor unit includes a test device positioned near the magnetic field sensor. The test device is selectively operable to create a magnetic field near the magnetic field sensor. After the test device has been operated, the control unit can determine whether the output signal from the sensor unit varies due to the change in the magnetic field.

In one embodiment of the invention, the test device is an electromagnet that can be selectively activated to change the magnetic field near the magnetic field sensor. Upon activation of the electromagnet, the output signal from the magnetic field sensor changes. If the test device is activated manually, the user can visually monitor the output signal to determine whether the magnetic field sensor unit is operating properly.

Alternatively, if the test device is automatically activated by the control unit, the control unit can determine whether the output signal changes after activation of the test device to insure that the magnetic field sensor of the sensor unit is operating properly.

Once the output signal for each of the magnetic field sensor units has been calibrated for ambient, steady state conditions, the control unit monitors the output signal from each of the magnetic field sensor units and compares the output signal to one or more detection thresholds set within the control unit by a user. The detection thresholds are preferably entered using an input device coupled to the control unit. Since the voltage output from the magnetic field sensor can vary in either a positive or negative direction from the initial calibrated output upon a change in the magnetic field, the control unit compares the output signal from each sensor unit to both the upper and lower detection thresholds. If the output signal from one or more of the magnetic field sensor units exceeds or falls below the detection thresholds, the control unit signals the presence of a railcar by adjusting the position of a contact member, such as an output relay. The position of the output relay is thus controlled based upon whether any of the magnetic field sensor units are detecting the presence of a railcar.

In a preferred embodiment of the invention, the control unit moves the contact member to a first position upon the output signal from any of the sensor units exceeding the upper or lower detection thresholds. Once the contact member is in the first position, the control unit will not move the contact member back to the second position until the output signal exceeds the upper or lower threshold plus or minus a hysteresis value, which prevents the continuous oscillation of the contact member when the output signal is very close to the detection thresholds.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
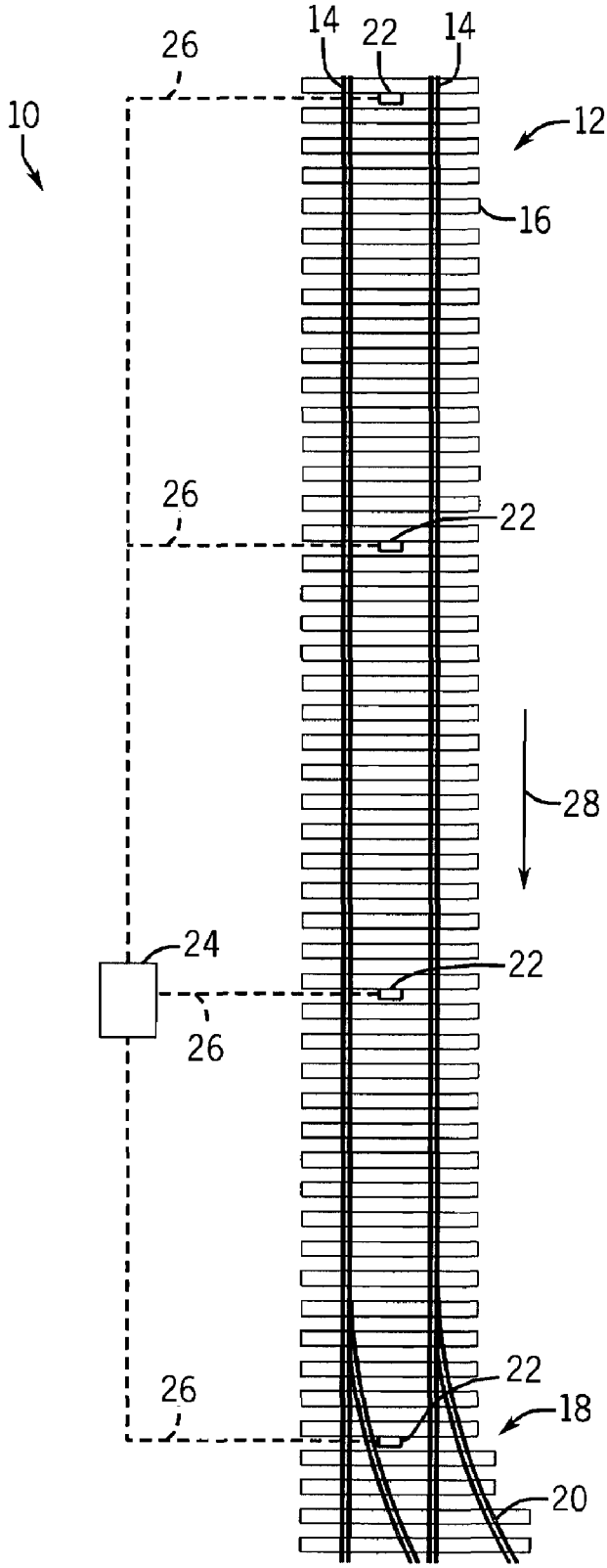
FIG. 1 is a schematic illustration of the railcar presence detector utilized with a length of rail track.

FIG. 1 illustrates a railcar detection system 10 that is operable to detect the presence of a railcar along the length of a two rail track 12. As illustrated in FIG. 1, the two rail track 12 includes a pair of spaced rails 14 mounted along a series of equally spaced ties 16. In the configuration shown in FIG. 1, the track 12 includes a switching section 18 that can be operated to switch a railcar from the first set of rails 14 to a second set of rails 20. Although not shown in FIG. 1, a switching device in the switching section 18 is operable to control the movement of a railcar from the first set of rails 14 to the second set of rails 20.

In the embodiment shown in FIG. 1, the railcar detection system 10 includes four separate sensor units 22 spaced along the length of the track 12. Each of the sensor units 22 is in communication with a tower interface 24 over one of the communication lines 26. In the embodiment shown in FIG. 1, the communication lines 26 are hard wire connections between the tower interface 24 and the sensor units 22. However, it is contemplated that the communication lines 26 could be replaced by wireless communication devices and techniques.

The tower interface 24 communicates bi-directionally to the series of sensor units 22 to both control the operation of the sensor units 22 and to receive sensing information from the sensor units 22. In addition, the tower interface 24 communicates with a rail yard control device (now shown) that controls the operation of various components within the rail yard, such as the position of the switching device used to direct railcars from the first set of rails 14 to the second set of rails 20. As will be described in much greater detail below, the railcar detection system 10, including the tower interface 24 and the series of spaced sensor units 22, detects the presence of a railcar on the rails 14 or 20, whether the railcar is stationary or moving in the direction illustrated by arrow 28.

In the embodiment shown in FIG. 1, the railcar detection system 10 includes four separate sensor units 22 that are spaced approximately 25 feet from each other along the length of the track 12. Although four separate sensor units 22 are shown in FIG. 1, it is contemplated that fewer sensor units, such as two or three, could be utilized while operating within the scope of the present invention. Preferably, the railcar detection system 10 will include at least the two sensor units 22 closest to the switching section 18, since these two sensor units 22 will detect the presence of a railcar as it approaches the switching section 18.

Figure 2:
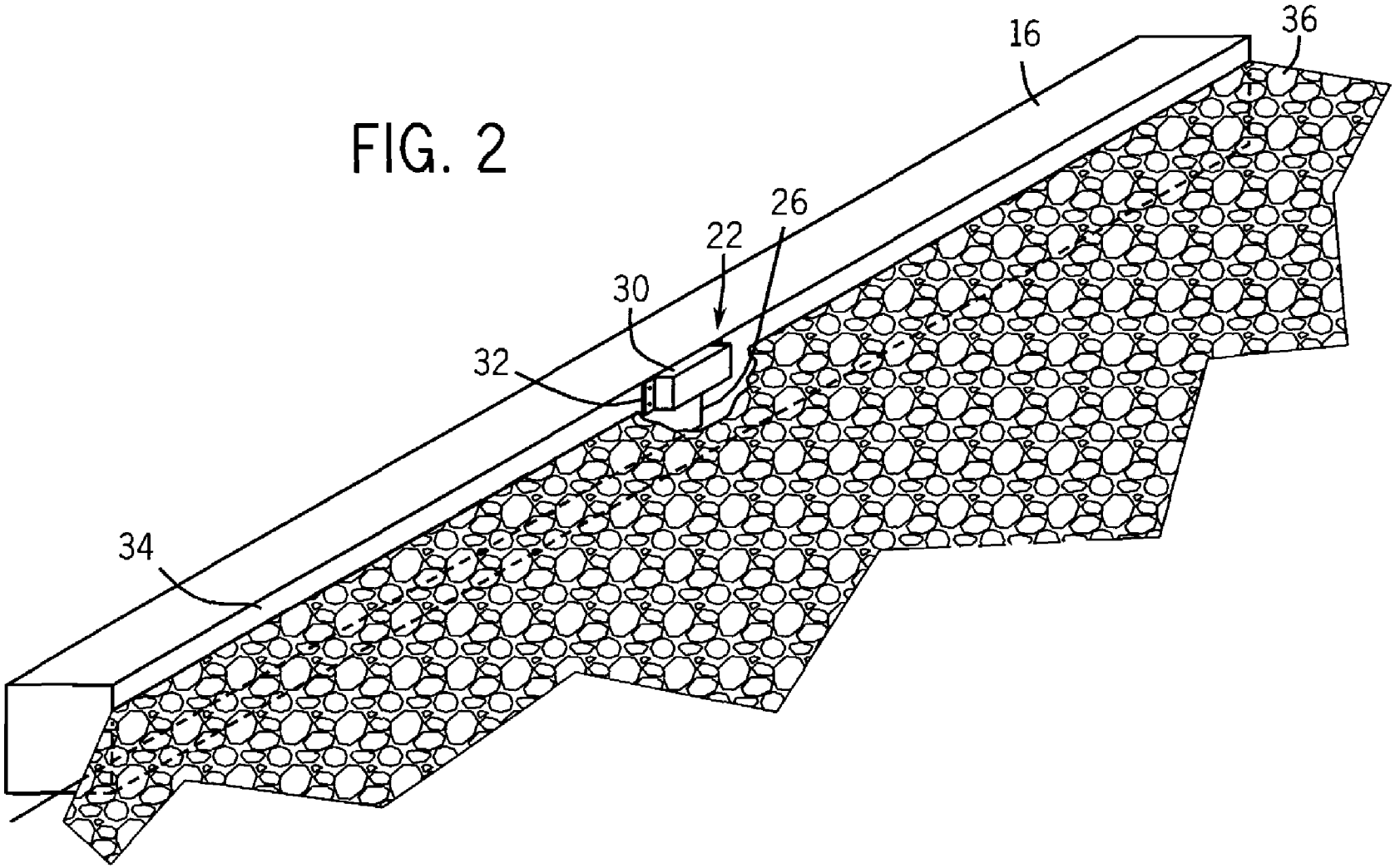
FIG. 2 is a perspective view of one of the magnetic sensor units mounted to one of the ties that extend between the rails of the rail track.

FIG. 2 illustrates the mounting of one of the sensor units 22 to one of the railroad ties 16. As illustrated in FIG. 2, the sensor unit 22 includes an enclosed outer housing 30 having a mounting flange 32 that allows the sensor unit 22 to be mounted to the downstream side 34 of the railroad tie 16. In the preferred embodiment shown in FIG. 2, the sensor unit 22 can be mounted beneath the level of the ballast 36 positioned between the railroad ties 16.

The sensor unit 22 is connected to the communication line 26 such that the sensor unit 22 is able to communicate to the tower interface 24. In the embodiment illustrated, the communication line 26 is also buried beneath the ballast 36 and thus protected from damage.

In the embodiment shown in FIG. 2, the communication line 26 includes a plug connector such that a new communication line 26 can be easily connected to the sensor unit 22 should the communication line 26 be severed or damaged. Further, since the entire sensor unit 22 is self-contained within the outer housing 30, the entire sensor unit 22 can be removed from the tie 16 and replaced should the sensor unit 22 become damaged. This modular construction of the railcar detection system allows for easier repair/replacement of damaged sensor units.

Figure 3:
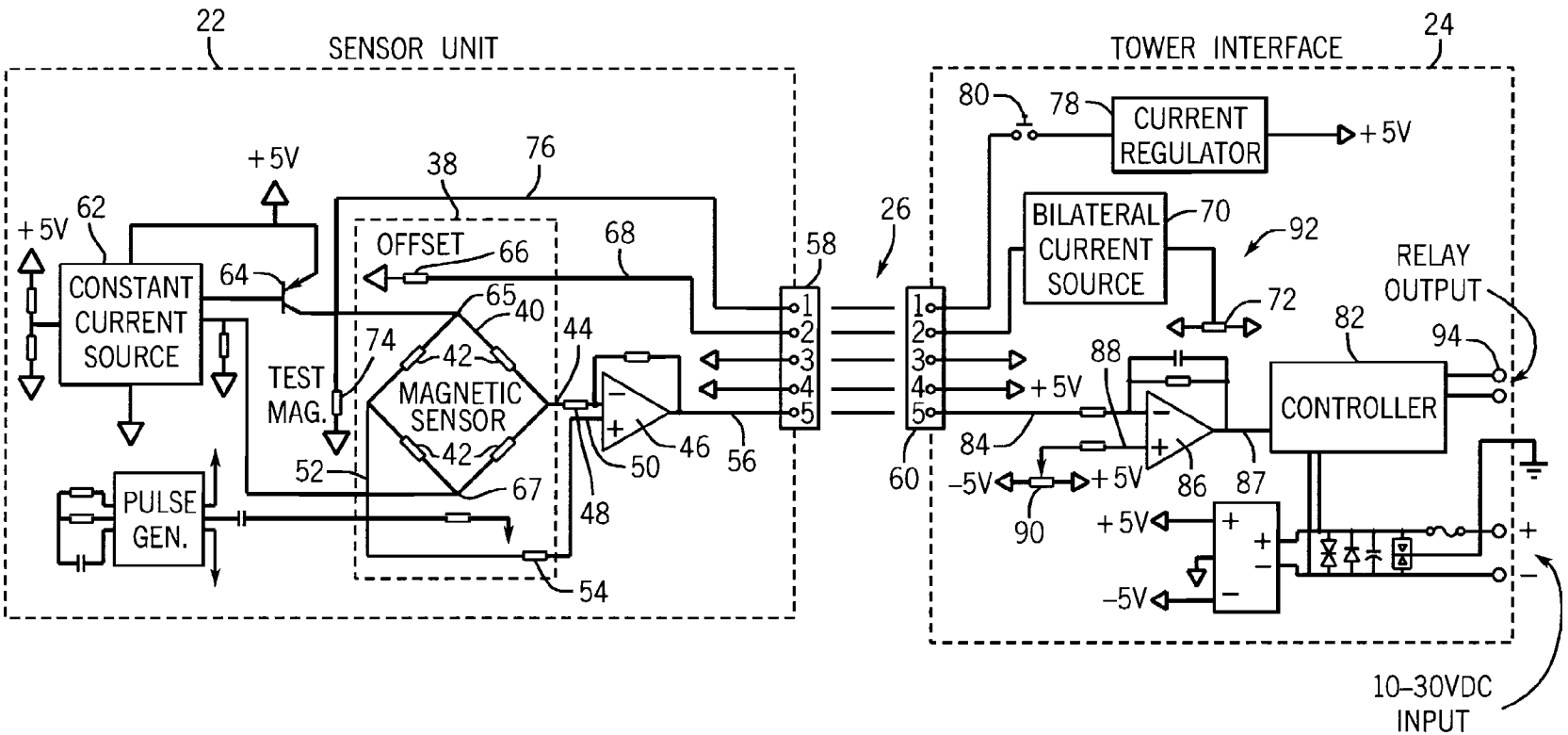
FIG. 3 is a circuit schematic diagram of the magnetic sensor unit and the operating components within the tower interface.

FIG. 3 illustrates the detailed configuration of one of the sensor units 22 and the communication between the sensor unit 22 and the tower interface 24 through the communication line 26. Although only a single sensor unit 22 is shown communicating to the tower interface 24 in FIG. 3, it should be understood that each of the four sensor units 22 shown in FIG. 1 communicate to the tower interface 24 in a manner to be described below.

Referring back to FIG. 3, the enclosed housing of the sensor unit 22 includes a magnetic field sensor 38 that is operable to detect the magnetic field in the area near the magnetic field sensor 38. In the embodiment shown, the magnetic field sensor 38 is a commercially available device, such as Part No. HMC 1021, available from Honeywell Sensor Products. The magnetic field sensor 38 includes a Wheatstone bridge 40 including four magnetoresistive elements 42. In the presence of an applied magnetic field, the resistance of the magnetoresistive elements 42 change, which results in an unbalanced Wheatstone bridge 40 and a voltage difference across the bridge. The voltage at pin 44 is received at one terminal of the comparator 46 through a resistor 48. The second terminal 50 is connected to the other output pin 52 through resistor 54 such that the comparator 46 amplifies the voltage difference across the Wheatstone bridge 40 to create a voltage output.

When the magnetic field near the magnetic field sensor 38 changes from a steady state due to the presence of ferromagnetic material, such as a railcar, the voltage output signal on the output line 56 of the comparator 46 changes. As illustrated in FIG. 3, the output line 56 is connected to pin 5 of the jumper 58. Jumper 58, in turn, is in communication with a corresponding jumper 60 of the tower interface 24 through the communication line 26.

As illustrated in FIG. 3, the magnetic field sensor 38 is connected to a constant current source 62 through a transistor 64. The constant current source 62 supplies a constant voltage to the top side 65 of the Wheatstone bridge 40, while the bottom side 67 of the Wheatstone bridge 40 is connected to ground through the constant current source 62.

As discussed previously, the magnetic field sensor 38 generates an output voltage along line 56 that is dependent upon the magnetic field present at the location where the magnetic field sensor 38 is mounted. Since the earth's magnetic field exists at the location where the sensor 38 is mounted, the magnetic field sensor 38 includes an offset strap 66 to compensate for the earth's ambient magnetic field. The offset strap 66 is driven by an adjustable current through the line 68 to offset the effect of the earth's magnetic field. The current flowing through line 68 is supplied by the connection to a current source 70 contained within the tower interface 24. The amount of current supplied to the offset strap 68 can be adjusted by controlling the position of an offset adjustment device 72. In the embodiment shown, the adjustment device 72 is a potentiometer connected to the current source 70. Adjustment of the potentiometer varies the current supplied to the offset strap 68.

During the initial setup of the sensor unit 22, the offset adjustment device 72 is adjusted until the voltage output on line 56 is approximately 2.5 volts when the magnetic field sensor 38 is in its install environment. The use of the offset strap 68 allows the magnetic field sensor 38 to compensate for the earth's magnetic field at the location where the magnetic field sensor 38 is positioned.

When the sensor unit 22 is installed as shown in FIG. 2, the presence of a large ferromagnetic device, such as a railcar, will change the magnetic field in the area near the sensor unit 22. In the preferred embodiment, the magnetic field sensor 38 is selected to be a one axis sensor that is specifically configured to detect the changing magnetic field along only a single axis. In the embodiment shown in FIGS. 1 and 2, the single sensing axis of the sensing unit 22 is aligned parallel to the rails 14. Aligning the sensing axis parallel to the rails 14 allows each of the sensor units 22 to detect railcars present along only the single track 12, which is particularly desirable in a rail yard having multiple tracks positioned adjacent to each other. The use of a single axis magnetic field sensor reduces the sensitivity of the sensor to railcars passing along tracks adjacent to the track 12 being monitored.

Referring back to FIG. 3, each sensor unit 22 further includes a test device 74 positioned in close proximity to the magnetic field sensor 38. In the embodiment of the invention shown in FIG. 3, the test device 74 is an electromagnet, such as contained in a magnetic relay, that can be actuated through the application of current along line 76. When current is present along line 76, the test device 74 creates a magnetic field, which results in the magnetic field sensor 38 generating a modified voltage output on the output line 56 as compared to the steady state voltage after the sensor unit was initially calibrated.

As illustrated in FIG. 3, a current regulator 78 is coupled to the jumper 60 through a test switch 80. When the test switch 80 is depressed, current from the current regulator 78 flows through the jumper 60 and into the connected jumper 58 to supply the current to the test device 74. When the test device 74 has been activated, the magnetic field sensor 38 generates a modified output voltage along line 56, which can then be detected by the tower interface 24.

Although the embodiment shown in FIG. 3 includes a manually activated test switch 80, it should be understood that the manually activated test switch 80 can be replaced by any type of switching device that can be either manually or electronically activated. As an example, the test switch 80 could be replaced by an electronic relay that can be selectively operated by the control unit 82, as will be described in much greater detail below.

As illustrated in FIG. 3, the output voltage present at line 56 is received within the tower interface through the jumper 60. The output voltage present on line 84 is fed to a comparator 86. The comparator 86 compares the output voltage on line 84 to a reference voltage present on line 88, which is controlled by the adjustment device 90. The output signal on line 87 from comparator 86 is fed into the control unit 82 for the entire tower interface 24. During initial calibration of the sensor unit 22, the adjustment device 90 provides fine calibration such that the output signal on line 87 is at approximately the midpoint between the voltage range of 0 to 5 volts (approximately 2.5 volts). Since the voltage on line 84 received at the comparator 86 can increase or decrease relative to the steady state, depending upon the change in the magnetic field due to the presence of a ferromagnetic object, the output signal on line 87 is set at the midpoint of approximately 2.5 volts when no ferromagnetic material is present. As shown in FIG. 3, the adjustment device 90 allows the adjustment voltage on line 88 to vary between −5 volts and +5 volts such that the output signal on line 87 can be calibrated to approximately 2.5 volts during steady state conditions.

Figure 4:
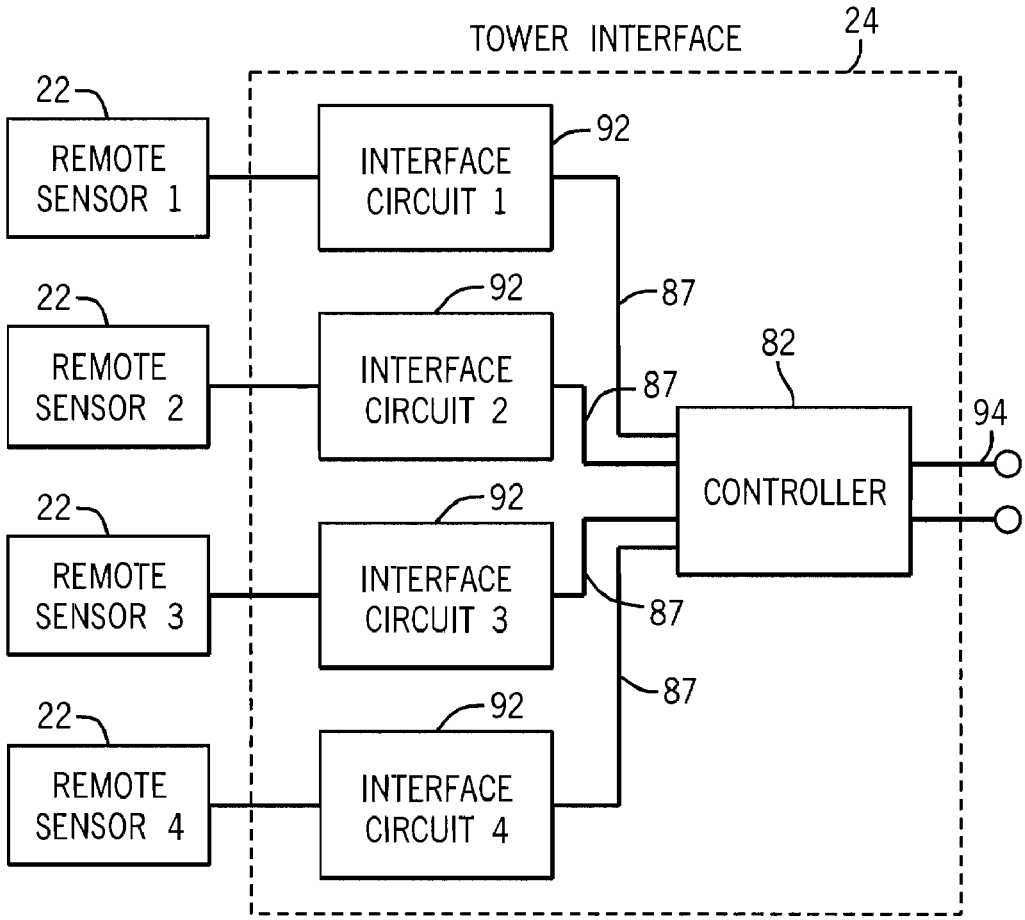
FIG. 4 is a schematic illustration of the communication between each of the remote sensor units and the control unit of the tower interface.

Referring now to FIG. 4, the tower interface 24 includes a single control unit 82 that receives an output signal from an interface circuit 92 associated with each of the four sensor units 22. The interface circuit 92 for each of the sensor units resides within the tower interface 24 and generally includes the current regulator 78, current source 70 and comparator 86, shown in FIG. 3. As shown in FIG. 4, each of the sensor units 22 includes its own interface circuit 92 contained within the tower interface 24. Each of the interface circuits 92 delivers a separate output signal to the control unit 82 along one of the lines 87. In the drawing of FIG. 3, only one of the interface circuits 92 is illustrated for the ease of understanding. However, it should be understood that multiple sensor units 22 and multiple interface circuits 92 must be included when the railcar detection system includes multiple sensor units positioned along the length of track.

Referring back to FIGS. 3 and 4, the control unit 82 is operatively connected to a relay contact output 94. During normal operation when none of the sensor units 22 are detecting the presence of a railcar, the control unit 82 generates a control signal to close the contact 94. Preferably, the contact output 94 is a normally open contact such that the control unit 82 must positively move the relay contact output to a closed state to indicate that no railcar is present. The use of normally open contact assures that during a malfunction or power loss, the relay contact output 94 will default to the normally open position, which indicates the presence of a railcar.

When the control unit 82 receives an output signal from any of the interface circuits 92 that is greater than either an upper or lower detection threshold, the control unit 82 moves the relay contact output 94 to the normally closed, railcar detecting position. The control unit 82 is configured to indicate the presence of a railcar any time any one or more than one of the plurality of interface circuits 92 is generating an output signal that falls outside of the upper and lower detection thresholds. In the application shown in FIG. 1, when any one of the spaced sensor units 22 detects the presence of a railcar, the tower interface 24 provides a relay output signal indicating the presence of the railcar. The presence of the railcar, in the embodiment shown in FIG. 1, prevents the switching section 18 from moving from its then current position, thereby preventing derailment of the railcar due to an unexpected and unwanted switching event.

Figure 5:
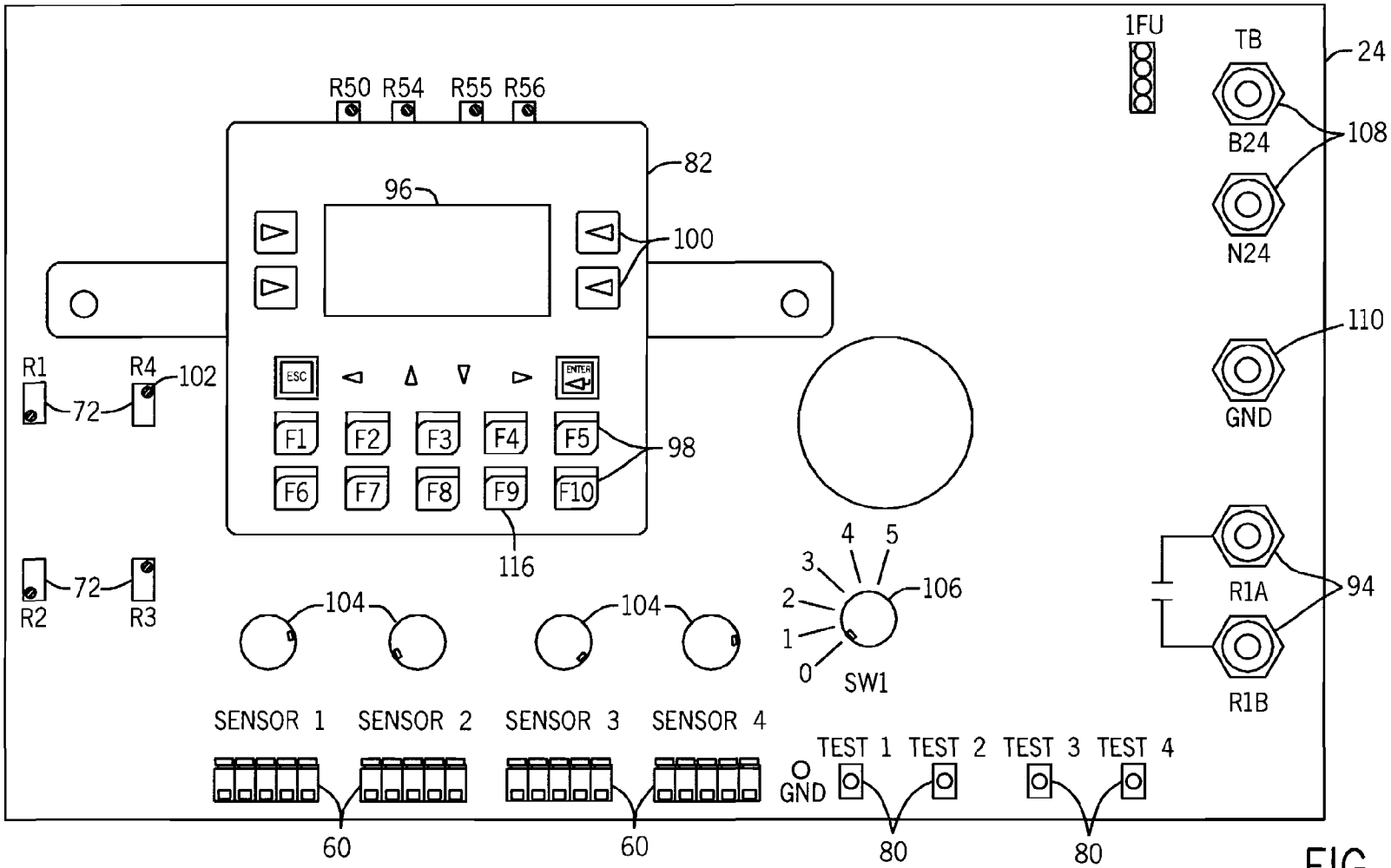
FIG. 5 is a front view of the tower interface that receives output signals from each of the magnetic field sensor units.

Referring now to FIG. 5, thereshown is the front face surface of the tower interface 24. The tower interface 24 includes the control unit 82, which in turn includes a display 96, a series of function keys 98 and a series of selection keys 100. In the embodiment of the invention shown in FIG. 5, the control unit 82 is the XLE OCS Model, available from Horner APG, although other control units are contemplated as being within the scope of the present disclosure.

The control unit includes multiple jumpers 60 such that the tower interface 24 can receive and communicate with multiple sensor units. As shown in FIG. 5, the tower interface 24 includes four jumpers such that the tower interface can communicate with four separate sensors. The tower interface 24 includes four separate test switches 80 each associated with one of the four sensors that can be connected to the tower interface. In addition to the test switches 80, the tower interface 24 includes four separate offset adjustment devices 72. As discussed previously in the explanation of FIG. 3, the offset adjustment devices 72 are operable to vary the current supplied to the offset strap 66 such that the offset strap 66 can compensate for the earth's magnetic field present at the installation location for the sensor unit 22. In the embodiment shown in FIG. 5, each of the offset adjustment devices 72 is a potentiometer having an adjustment screw 102 to vary the resistance of the potentiometer.

In addition to the adjustment devices 72, the tower interface 24 includes an adjustment knob 104 associated with each of the sensors that can be connected to the tower interface 24. The adjustment knob 104 allows for fine calibration of the output signal from the sensor unit when the sensor unit is initially installed and calibrated. The adjustment knobs 104 correspond to the adjustment device 90 shown in FIG. 3.

The tower interface 24 further includes a selection switch 106 that can be moved between one of six positions, as illustrated. When the selection switch is in positions 1-4, the corresponding sensor unit can be calibrated using a combination of the offset adjustment device 72 and the adjustment knob 104 for the selected sensor. Additionally, depending upon the position of the selection switch 106, a visual representation of the sensor unit will be shown on the display 96. The tower interface 24 further includes a pair of power connections 108, a ground connection 110 and the relay contact outputs 94.

The setup and operation of the railcar detection system 10 will now be described with particular reference to the screen shots that are shown on the display 96 during operation of the railcar detection system. Initially, each of the individual sensor units 22 are physically positioned on the railroad ties 16, as illustrated in FIG. 2. The communication line 26 for each of the sensor units 22 is then connected to the tower interface 24 through one of the jumpers 60. As can be understood in FIG. 3, the connection between the sensor unit 22 and the tower interface 24 is completed by the communication line 26 extending between the jumper 58 on the sensor unit 22 and the jumper 60 on the tower interface 24. As described previously and shown in FIG. 5, the tower interface 24 can receive and communicate with up to four sensors in the embodiment shown. Although four sensor inputs are shown in FIG. 5, it is contemplated that the tower interface 24 could be configured to receive fewer sensor inputs depending upon the requirement for the rail yard in which the rail car detection system is utilized.

Once all of the sensor units have been connected to the tower interface 24, the user interacts with the tower interface 24 to calibrate each of the sensor units, and specifically to calibrate the output signal from each sensor unit. During the initial setup, the user is first presented with the screen shown in FIG. 6(*i*). This screen visually represents the four sensors that are part of the railcar detection system and includes a visual indication of whether each of the sensors is in an on or off state. In the display shown in FIG. 6(*i*), sensors 1 and 2 are on, while sensors 3 and 4 are off. The user can toggle between the on and off indicator by depressing the selection keys adjacent to each of the sensor indicators 111 on the display screen.

Figure 6:
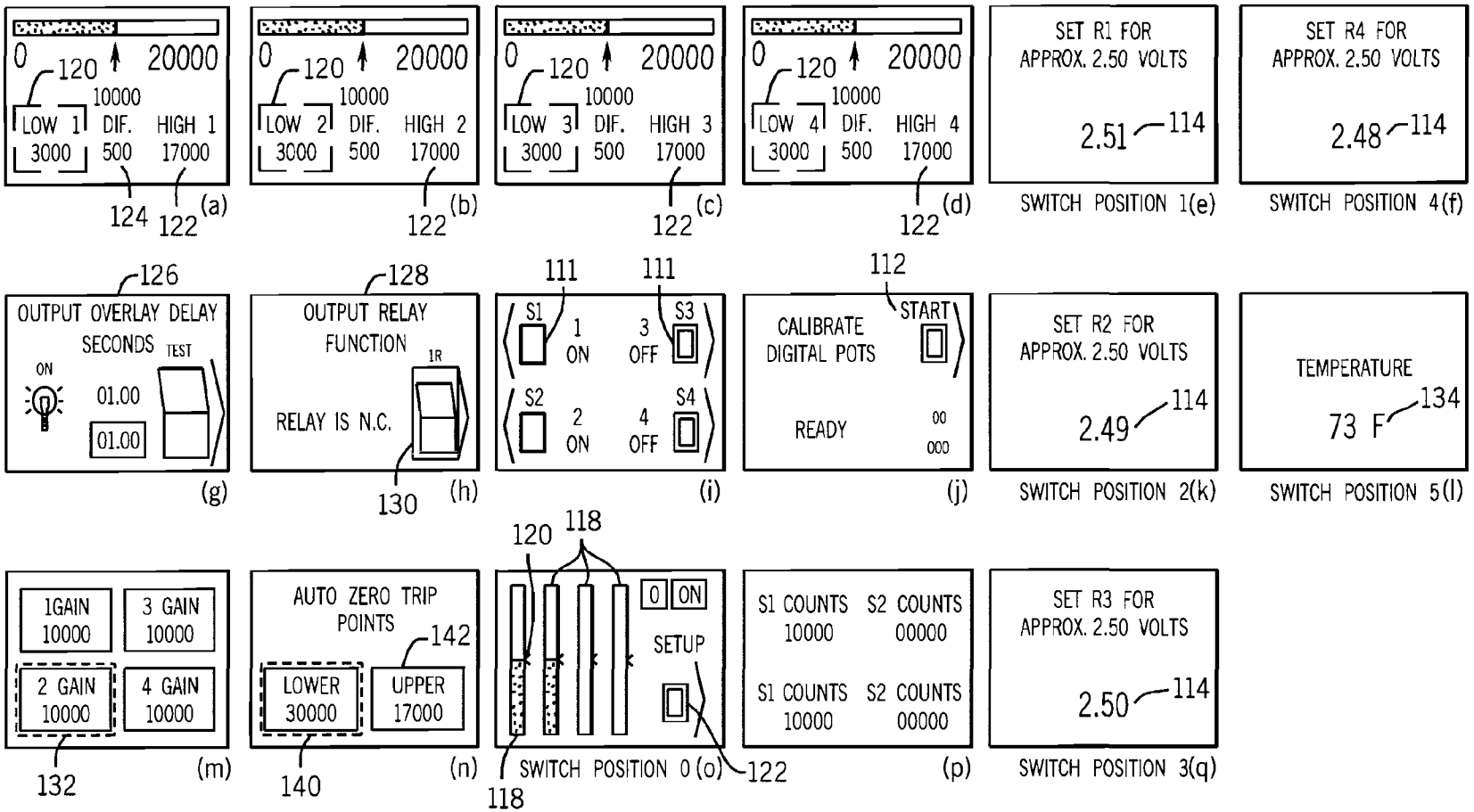
FIG. 6 is a series of screen shots illustrating the screens displayed on the control panel of the tower interface.

After the user has entered the number of sensors, the user is presented with the screen shot shown in FIG. 6(*j*). As the screen shot indicates, the control unit indicates to the user that the control unit is ready to calibrate each of the sensors. When the user is ready to begin, the user depresses the selection key adjacent to the start indicator 112. Once the selection key adjacent to the start indicator 112 has been depressed, the user moves the selection switch 106 to the position indicating sensor 1. After the selection switch 106 has been adjusted to select sensor 1, the display screen will show the screen indicated by FIG. 6(*e*). Once the user sees the screen shown in FIG. 6(*e*), the user can then adjust the offset adjustment device 72 corresponding to sensor 1 (R1) until the voltage output from the comparator 86 (FIG. 3) is approximately 2.5 volts, which is midway between the 0-5 volt output range of the comparator 86. As illustrated in FIG. 6(*e*), the display shows the actual voltage 114 from the comparator 86 (FIG. 4) being fed into the control unit 82. This process is repeated for each of the four sensors, as illustrated in FIGS. 6(*f*), 6(*k*) and 6(*q*).

After each of the sensing units has been roughly calibrated utilizing the offset adjustment devices 72, the user can depress the F9 key 116 shown in FIG. 5 to return the control unit to the setup screen. Once the system is in the setup mode, as shown in FIG. 6(*o*), the user can turn the adjustment knobs 104 until the darkened portion 118 of the bar graph for each of the sensors is centered at the midpoint 120. The darkened portion 118 represents the output signal for the sensor unit. In the screen shown in FIG. 6(*o*), only sensors 1 and 2 are active while sensors 3 and 4 are currently not in service. As described previously, the output signal for each of the sensor units is centered within its operating range during steady state, ambient conditions when a railcar is not present. Since the presence of a railcar or any other large ferromagnetic material will cause the output voltage from the sensor unit to either increase or decrease depending upon the change in the resistive elements within the magnetic field sensor 38, it is important that the output signal from the sensor unit be centered between the maximum and minimum output voltage range from the comparator 86. Once the bar graph 118 for each of the sensors has been centered, the user can press the selection key next to the display indicator 122 to return to the run screen. After centering the bar graphs 118, the system has been calibrated and is ready for operation.

As described previously, the control unit 82 receives an output signal, represented by a voltage, from the interface circuit 92 associated with each of the sensor unit 22, as best shown in FIG. 3. Although the control unit 82 receives an analog voltage signal from each of the comparators 86, the control unit 82 includes an analog to digital (A/D) converter that converts the analog output signal from each comparator 86 into a digital count. In the preferred embodiment of the invention, a 0 volt output signal represents a count 0, while the maximum, 5 volt output signal is represented by the maximum count 20,000. Since it is desired to center the output signal from each sensor unit for steady state, ambient conditions when no railcars are present, each of the sensor units is calibrated to have an initial count of approximately 10,000.

Figure 7:
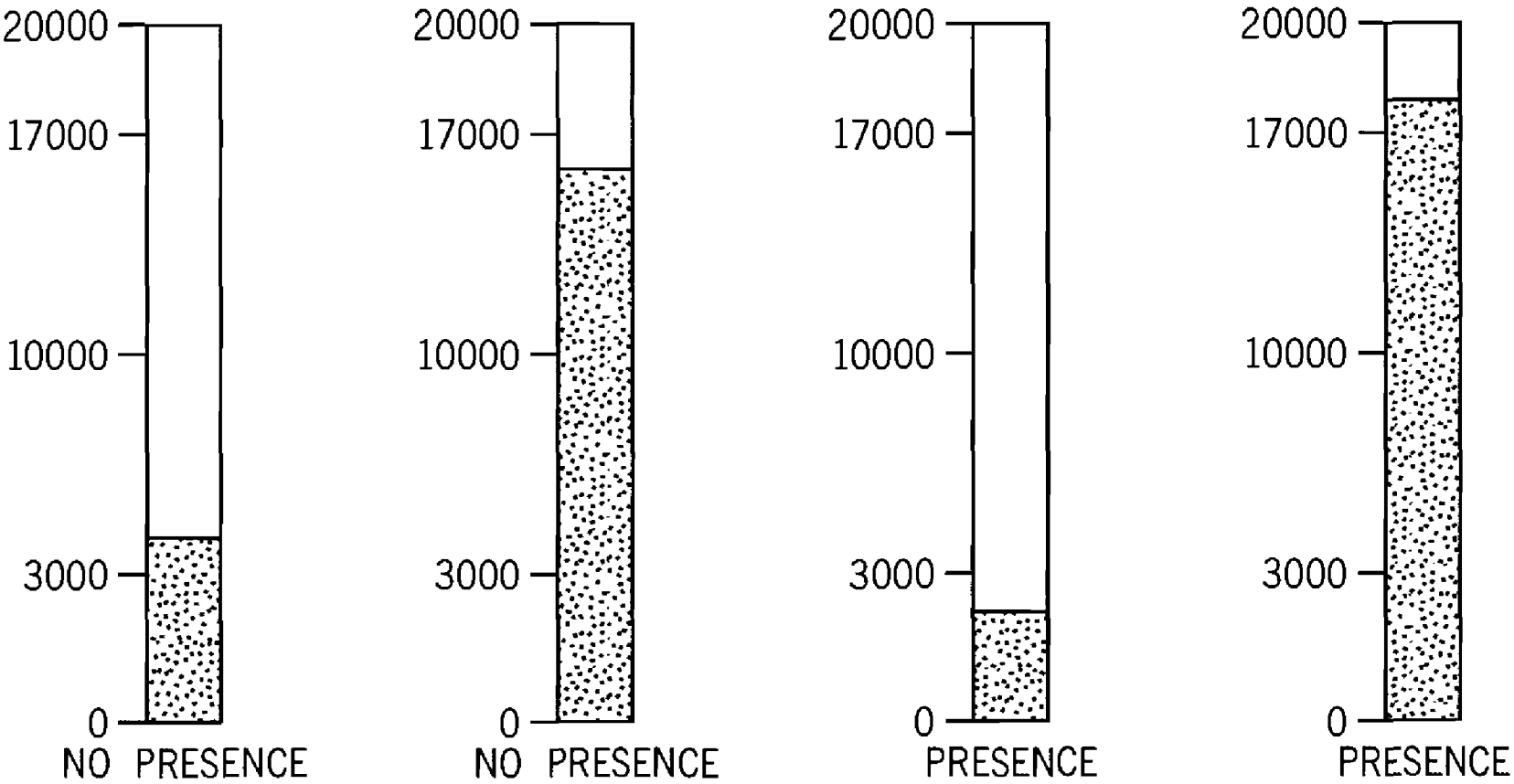
FIG. 7 is a graph illustration of the output signal from one of the sensor units and the upper and lower detection thresholds.

Referring now to FIG. 7, thereshown are bar graphs illustrating the method in which the control unit 82 determines whether the output signal from any one of the interface circuits indicates the presence of a railcar. As shown, the midpoint of the graph is represented by a count of 10,000, while the upper maximum is represented by 20,000 and the absolute minimum is at count 0. FIG. 7 indicates a lower threshold 120 (3000) and an upper threshold 122 (17,000) for the specific sensor unit. When the converted count value representing the output signal exceeds the upper threshold 122 or falls below the lower threshold 120, the control unit indicates that a railcar has been detected. In the embodiment shown in FIG. 7, the upper threshold 122 and the lower threshold 120 are selected to be 7,000 above and below the midpoint 121. However, the user can modify the upper and lower thresholds 122, 120 depending upon the required sensitivity for the railcar detection system.

Referring now to FIGS. 6(*a*)-6(*d*), thereshown is the bar graph for the upper and lower thresholds for each sensor unit that cause the control unit to indicate the presence of a railcar. As shown in FIG. 6(*a*), the sensor output is centered at a count of 10,000, which is the center point between the maximum (20,000) and minimum (0) count. The display of FIG. 6(*a*) indicates that the lower threshold 120 is 3,000 while the upper threshold 122 is 17,000. In the screen shot shown in FIG. 6(*a*), the lower threshold 120 is highlighted and can be adjusted by the user if desired. As can be understood in FIGS. 6(*b*)-6(*d*), similar upper and lower thresholds are set for sensors 2, 3 and 4.

As can be understood in FIG. 6(*a*), when the converted output signal count generated by the analog to digital converter of the control unit 82 falls below 3,000 or exceeds 17,000, the control unit will indicate that a railcar has been detected. The control unit further includes a hysteresis value 124 that is added to the lower threshold 120 and subtracted from the upper threshold 122 once the control unit signals the presence of a railcar. As an example, if a railcar is present and causes the sensor outputs to exceed 17,000, the control unit will continue to indicate a railcar presence until the value of the output signal falls below 16,500. Likewise, if a railcar is present and causes the sensor output to fall below 3,000, the control unit will continue to indicate a railcar presence until the value of the output signal rises above 3,500.

The hysteresis value 124 prevents the control unit from repeatedly toggling between the open and closed position of the output relay when the sensor value is near the lower threshold 120 or the upper threshold 122. Additionally, the use of the hysteresis allows the operator to set the lower and upper thresholds 120, 122 a significant distance away from the center count value to aid in discriminating between the presence of a railcar on the track being monitored and the presence of a railcar on an adjacent track. Specifically, when a railcar approaches one of the sensor units, the relatively large amount of ferromagnetic material near the front of the railcar, including the wheels and axle, has a more significant effect on the sensed magnetic field than the remaining portions of the railcar. Thus, as the railcar approaches one of the sensor units, the leading end of the railcar causes the sensor output to vary a significant amount from the center value. However, as the railcar continues to proceed, the remaining portions of the railcar will have a less significant effect on the sensed magnetic field, which will cause the sensor output to move closer to the center position. The use of the hysteresis value 124 prevents the control unit from indicating that no railcar is present as the less metallic center portion of the railcar passes over the sensor unit.

An additional advantage of setting the lower and upper thresholds 120, 122 at a relatively high value is that railcars on adjacent tracks will be less likely to create a magnetic field disturbance that causes any of the sensor outputs to either exceed the upper threshold 122 or fall below the lower threshold 120. In this manner, the hysteresis value aids in preventing false railcar presence signals due to railcars on adjacent tracks.

FIG. 6(*g*) illustrates an output relay delay screen 126 that provides a delay between the time that all of the sensors indicate no railcar presence and the control unit generates a no presence state to the control tower. As illustrated in FIG. 6(*g*), the default is one second. However, the default can be set between 0 and 9.9 seconds. Preferably, the default of one second is utilized since ferromagnetic mass may be aligned so that it does not alter the local magnetic field for a short period of time. The delay of one second assures that if a railcar is present, the one second delay will prevent the control unit from generating a signal prematurely.

FIG. 6(*h*) presents an output relay function screen that indicates that the relay is set as a normally closed contact. To change the status of the relay, the user can depress the selection key adjacent to the indicator 130. However, it is preferred that the relay be set up on a normally open position such that the default position upon power loss or failure is for the system to indicate a railcar presence.

FIG. 6(*m*) illustrates the screen shot that allows the user to change the sensitivity of the sensors. As illustrated in FIG. 6(*m*), the default gain for each of the sensors is 10,000. To alter the gain of any one of the sensors, the user depresses the selection key next to the desired sensor, which causes the sensor to be highlighted, as shown by the box 132. A new value for the gain can be entered using the numeric keypad. The gain value can be set between 2,000 and 10,000. Reducing the gain value to 2,000 will make the sensor much more sensitive and may result in sensing railcars on adjacent tracks. The gain of the sensors may be modified after the user has monitored the presence detector as different types of railcars pass to insure that a presence is being sensed at the required time and that the presence is indicated the entire time the car passing. In the event that the output from the tower interface is not meeting the user requirements, the user can adjust the sensitivity of the sensors, the sensors can be moved to more desirable locations, the hysteresis can be adjusted, additional sensors can be added or the output relay timing can be changed.

FIG. 6(*l*) indicates the display screen when the selection switch 106 is moved to position 5. This display screen indicates the temperature in the area surrounding the tower interface, as indicated by the temperature display 134. During normal operation of the railcar detection system of the present invention, the tower interface display includes the screen shown in FIG. 6(*o*). In this screen, the output signal from each of the sensor units is simultaneously displayed such that an operator can simultaneously monitor whether any of the multiple sensor units are detecting the presence of a railcar. In situations in which the tower interface is positioned near the track being monitored, an operator could visually inspect the track to determine whether a railcar is present. If a railcar is present and the bar graph 118 for the sensor is not indicating a railcar presence, the operator can identify the faulty operation. Since each output signal from the sensor unit is simultaneously displayed, the operator can then determine which of the multiple sensors is operating incorrectly.

As discussed previously, each of the sensor units can be manually tested by depressing the test switch 80 corresponding to the sensor unit that needs to be tested. Once the test switch 80 has been depressed, the test device creates a magnetic field near the magnetic field sensor, which will cause the output signal for the specific sensor to either exceed the upper threshold or fall below the lower threshold. The output signal from the sensor being tested can be visually monitored on the display, as shown by the screens of FIG. 6(*o*). If the operator can visually confirm that the output signal changes upon depression of the test switch, the operator can be assured that the sensor is currently operating correctly.

Although manual operation of the test switch is contemplated, it is also contemplated that the control unit 82 could automatically activate the test switch 80 at desired intervals. As an example, after an extended period of operation, the control unit can automatically actuate the test switch 80 and monitor whether the output signal from the sensor being tested exceeds the upper threshold or falls below the lower threshold. If the sensor is operating improperly, the control unit can then either automatically recalibrate the magnetic field sensor or indicate to the operator that an error is present.

FIG. 6(*n*) illustrates an auto-zero screen that can also be carried out by the control unit. The auto-zero feature allows the control unit to re-zero any one of the sensor units to bring the steady state count for the sensor unit back to 10,000. This may be required upon either a physical change to the environment surrounding the sensor unit or upon drastic temperature changes.

During normal operation, if the output signal from any one of the sensors falls below the lower count limit 140 or exceeds the upper count limit 142, the control unit automatically re-centers the count for ambient conditions for the sensor. In the embodiment shown in FIG. 6(*n*), the lower count limit is set at 5,000 and the upper limit is set at 15,000. The values for the upper and lower limits 140, 142 must be within the range of no presence for the auto-zero feature to be active. Thus, if the tower interface is indicating railcar presence through any of the sensor units, the control unit will not auto-zero. In order for the control unit to auto-zero the sensors, the sensor output signal must be below the lower limit 140 or above the upper limit 142 yet not indicating the presence of a railcar for a predetermined period of time, which may be selected as a period of minutes. If the output signal falls below the lower limit 140 or exceeds the upper limit 142 for longer than the predetermined period of time, the control unit will automatically bring the number of counts of the output signal for the normal state back to 10,000. This feature is an enhanced feature of the railcar detection system and does not need to be activated in all embodiments.

We claim:

1. A system for detecting the presence of a railcar on a two rail track, comprising:

at least one magnetic field sensor positionable between rails of the two rail track and operable to generate an output signal dependent upon a magnetic field near the magnetic field sensor;

a control unit in communication with the at least one magnetic field sensor to receive the output signal and compare the output signal to at least one detection threshold;

a test device positioned near the magnetic field sensor and selectively operable to modify the magnetic field near the magnetic field sensor; and a contact member movable between a first position and a second position and in communication with the control unit, wherein the control unit controls the position of the contact member based upon the comparison of the output signal to the at least one detection threshold.

2. The system of claim 1 further comprising an offset device positioned near the magnetic field sensor, the offset device being selectively activated to adjust the output signal.

3. The system of claim 1 wherein the test device is an electromagnet that is selectively energizable to modify the magnetic field near the magnetic sensor.

4. The system of claim 3 wherein the test device is manually energizable.

5. The system of claim 3 wherein the control unit is operable to automatically energize the test device.

6. The system of claim 5 wherein the control unit automatically energizes the test device after a duration of time following operation.

7. The system of claim 1 wherein the control unit includes an upper threshold and a lower threshold for the output signal, wherein the control unit causes the contact member to enter the first position when the output signal exceeds the upper threshold or falls below the lower threshold.

8. The system of claim 1 wherein the magnetic field sensor operates to generate a sensing plane parallel to the two rails of the track.

9. The system of claim 1 further comprising an input device in communication with the control unit, the input device being operable to select the at least one detection threshold.

10. The system of claim 1 further comprising a display included on the control unit to display a visual representation of the output signal from the at least one magnetic field sensor.

11. The system of claim 10 wherein the control unit includes an upper threshold and a lower threshold for each of the output signals, wherein the control unit causes the control member to enter the first position when the output signal from any of the magnetic field sensors exceeds the upper threshold or when the output signal from any of the magnetic field sensors falls below the lower threshold.

12. The system of claim 11 wherein the control unit further comprises a hysteresis value to be applied to the upper threshold and the lower threshold to adjust the upper and lower thresholds when the output signal from any of the magnetic field sensors exceeds the upper threshold or falls below the lower threshold.

13. The system of claim 12 wherein the hysteresis value, the upper threshold and the lower threshold are user selectable.

14. A system for detecting the presence of a railcar on a two rail track, comprising:

a plurality of magnetic field sensors positionable along a length of the two rail track, each of the magnetic field sensors being operable to generate an output signal dependent upon the magnetic field near the magnetic field sensor, wherein the output signal changes upon a disruption in the magnetic field caused by ferromagnetic objects passing over the magnetic field sensor;

a control unit in communication with each of the magnetic field sensors to receive the output signal from each of the magnetic field sensors and compare the output signals to at least one detection threshold;

a contact member movable between a first position and a second position, the contact member being in communication with the control unit such that the control unit controls the position of the contact member based upon the comparison of the output signal of each of the magnetic field sensors to the detection threshold; and a display included on the control unit to display a visual representation of the output signal for each of the magnetic field sensors.

15. The system of claim 14 wherein the output signal from each of the magnetic field sensors is visually represented simultaneously.

16. The system of claim 14 further comprising a test device associated with each of the magnetic field sensors, each test device being independently operable to modify the magnetic field near the magnetic field sensor.

17. The system of claim 16 wherein the test device is an electromagnetic that is selectively energizable to modify the magnetic field near the magnetic sensor.

18. The system of claim 17 wherein each of the test devices is manually energizable.

19. The system of claim 17 wherein the control unit is operable to automatically energize each of the test devices.

20. The system of claim 14 further comprises an offset device associated with each of the magnetic field sensors.

21. The system of claim 20 wherein the offset device is positioned near the magnetic field sensor and is selectively activated to adjust the output signal of the magnetic field sensor.

22. The system of claim 14 further comprising an input device in communication with the control unit, the input device being operable to select the at least one detection threshold.

* * * * *